US005993170A

United States Patent [19]

Stevens et al.

[11] Patent Number: 5,993,170

[45] Date of Patent: Nov. 30, 1999

[54] APPARATUS AND METHOD FOR COMPRESSING HIGH PURITY GAS

[75] Inventors: Joe Stevens, San Jose; Allen Thompson, San Carlos; Norman Cowan, Fremont; David Alvarez, San Jose, all of Calif.

[73] Assignee: Applied Materials, Inc., Santa Clara, Calif.

[21] Appl. No.: 09/057,518

[22] Filed: Apr. 9, 1998

[51] Int. Cl.[6] ..... H05B 1/00

[52] U.S. Cl. ..... 417/244

[58] Field of Search ..... 417/244, 269, 417/53, 437; 137/218, 459; 415/92; 277/54, 88

[56] References Cited

U.S. PATENT DOCUMENTS

| | | | |
|---|---|---|---|
| 3,584,978 | 6/1971 | Shimoi | 417/67 |
| 3,844,689 | 10/1974 | Weatherston | 417/572 |
| 3,969,039 | 7/1976 | Shoulders | 417/244 |
| 4,010,768 | 3/1977 | Hechler, IV | 137/218 |
| 4,080,107 | 3/1978 | Ferrentino | 417/53 |
| 4,257,230 | 3/1981 | Lundholm . | |
| 4,361,418 | 11/1982 | Tscheppe | 417/54 |
| 4,512,151 | 4/1985 | Yamatani . | |
| 4,556,369 | 12/1985 | Braun . | |
| 4,583,921 | 4/1986 | Wolff et al. | 417/269 |
| 4,718,836 | 1/1988 | Pottier et al. | 417/205 |
| 4,795,315 | 1/1989 | Schultze | 417/68 |
| 4,889,350 | 12/1989 | Tranter . | |
| 4,900,233 | 2/1990 | Ripley . | |
| 4,901,413 | 2/1990 | Cotherman et al. | 29/890.14 |
| 4,951,743 | 8/1990 | Henderson . | |
| 5,046,929 | 9/1991 | Novotny et al. . | |
| 5,049,168 | 9/1991 | Danielson | 55/17 |
| 5,076,765 | 12/1991 | Yagi et al. . | |
| 5,154,737 | 10/1992 | Jenkins et al. . | |
| 5,238,362 | 8/1993 | Casaro et al. . | |
| 5,244,363 | 9/1993 | Olson . | |
| 5,265,423 | 11/1993 | Glaser . | |
| 5,383,334 | 1/1995 | Kaminishizono et al. . | |
| 5,613,843 | 3/1997 | Tsuru et al. | 417/313 |
| 5,863,186 | 1/1999 | Green et al. | 417/53 |

*Primary Examiner*—Philip H. Leung
*Assistant Examiner*—Daniel L. Robinson
*Attorney, Agent, or Firm*—Dugan & Dugan

[57] ABSTRACT

An improved method and apparatus are disclosed for isolating product gas from compressor operating fluid. A portion of a piston rod directly exposed to the compressor's operating fluid (the oily portion of the piston rod) is atmospherically isolated from the remaining portion of the piston rod by providing the piston rod with a collar that separates the oily portion of the piston rod from the remainder of the piston rod. A first and a second flexible membrane are coupled to the collar to form a first isolation region, and a second isolation region; the first isolation region encases the oily portion of the piston rod and atmospherically isolates it from the second isolation region, and the second isolation region provides additional isolation from both the operating fluid and the ambient environment. A higher pressure is maintained along the backside of the piston that compresses the product gas than the pressure within the adjacent isolation region. Pairs of wipers with vents coupled therebetween additionally may be employed to further improve product gas isolation.

21 Claims, 6 Drawing Sheets

APPARATUS AND METHOD FOR COMPRESSING HIGH PURITY GAS

BACKGROUND OF THE INVENTION

The present invention relates generally to the field of compressors and specifically to preventing cross-contamination of the diverse fluid mediums present in a piston driven pressure intensifier.

An overriding concern in the compressor field is product gas (i.e., the gas compressed by the compressor) contamination from the intermixing of the product gas with operating fluids (e.g., hydraulic fluids or other compressor fluids) during the compression process. Product gas contamination is particularly problematic in semiconductor processing applications such as isostatic pressing processes which require high purity compressed gases and pressure levels of approximately 1000 atmospheres. In order to achieve such high pressures, a number of hydraulic piston driven compressors are interconnected so as to provide staged pressure increases. Staged pressure increases allow a gas to be pressurized without a substantial increase in gas discharge temperature (e.g., by using inter-stage coolers to cool the gas between stages). Specifically a compressed gas output from a first hydraulic piston driven compressor (i.e., a first "stage") passes through an inter-stage cooler and is input to the next hydraulic piston driven compressor (i.e., the second stage) where it is further compressed, cooled and passed to the next stage, and so on. In this manner gas pressure increases gradually and exceedingly high gas discharge temperatures are avoided.

In order to understand how the present invention reduces product gas contamination, it is first necessary to understand how conventional piston-type compressors increase gas pressure. With this understanding, the problems which cause product gas contamination in conventional compressors will be apparent.

Referring to FIG. 1, one stage (i.e., one compressor 11) of a conventional piston-type multi-stage compressor is depicted in section. Each compressor 11 typically comprises a hydraulic chamber 13 containing hydraulic fluid (e.g., oil) and a hydraulic piston 15, and a gas chamber 17 that includes an inlet 19 for receiving the gas to be compressed (i.e., product gas) and an outlet 21 for supplying compressed product gas to a subsequent stage or to a standard processing chamber. The gas chamber 17 further includes a gas piston 23 operatively coupled to the hydraulic piston 15 by a piston rod 25 that extends through and is slidably mounted in a bore 27 (hereinafter "hydraulic bore 27") in the hydraulic chamber 13 and a bore 29 (hereinafter "gas bore 29") in the gas chamber 17.

In operation, a motor (not shown) operatively coupled to the piston rod 25 moves the piston rod 25 back and forth. When the piston rod 25 moves toward the hydraulic chamber 13 (i.e., during a frontstroke) product gas is drawn into the gas chamber 17 via the inlet 19; as the piston rod 25 moves toward the gas chamber 17 (i.e., during a backstroke) product gas is compressed and, after a desired pressure is obtained, the compressed product gas is exhausted from the gas chamber 17 via the outlet 21. Typically the hydraulic piston 15 is also coupled to a gas piston of a second stage (not shown). In this manner one gas piston draws in product gas as the other gas piston compresses product gas.

In an effort to prevent contamination of the product gas by hydraulic fluid that leaks from the hydraulic bore 27, migrates along the piston rod 25 and enters the gas chamber 17 via the gas bore 29, conventional compressors contain a first wiper 31 mounted along the piston rod 25 adjacent the hydraulic chamber 13, and/or a second wiper 33 mounted along the piston rod 25 adjacent the gas chamber 17. As the piston rod 25 passes through either wiper, a substantial portion of hydraulic fluid is wiped (i.e., removed) from the piston rod 25. Conventional compressors further provide the gas piston 23 with a number of seals (not shown) coupled between the outer surface of the gas piston 23 and the inner surface of the gas chamber 17, and vent the backside of the gas piston 23 (i.e., the portion of the gas chamber 17 located between the hydraulic chamber 13 and the gas piston 23) to ambient air. Another conventional method for reducing product gas contamination is to flow product gas to the backside of the gas piston 23 in an attempt to prevent ambient air contaminants from entering the backside of the gas chamber 17, adhering to the gas chamber's 17 walls and then transferring to the product gas as the gas piston 23 moves toward the hydraulic chamber 13.

While these conventional techniques do reduce product gas contamination to some extent, product gas contamination by hydraulic fluid particles nonetheless persists. Such contamination is particularly problematic in the semiconductor device fabrication field wherein a trace amount of hydraulic fluid may destroy a semiconductor device valued at $100,000 or more. Accordingly, a need exists in the compressor field for an apparatus and method that effectively isolates product fluid (e.g., product gas) from compressor operating fluid (e.g., hydraulic fluid).

SUMMARY OF THE INVENTION

In response to the shortcomings of the prior art, the present invention provides an apparatus and method for isolating a first fluid medium (e.g., product gas) from a second fluid medium (e.g., hydraulic fluid) within a compressor. The present invention atmospherically isolates the portion of the piston rod that is directly exposed to the hydraulic fluid (i.e., the oily portion of the piston rod) from the remaining portion of the piston rod. Preferably, in order to isolate these regions of the piston rod, a collar is fixedly mounted to (i.e., rigidly attached and sealed to or integrally formed as part of) the piston rod. The collar is positioned so as not to inhibit either the forward or backward stroke of the piston rod and so that the oily portion of the piston rod is entirely segregated to one side of the collar. A first flexible membrane is sealingly coupled between the collar and the hydraulic chamber and thus forms a first isolation region around the oily portion of the piston rod. Similarly a second flexible membrane is sealingly coupled between the collar and the gas chamber and thus forms a second isolation region around the remaining portion of the piston rod. The collar serves as a base on which to mount the flexible membranes and more effectively prevents hydraulic fluid migration than do conventional wipers.

Because the collar is fixedly mounted to the piston rod unlike the slidably mounted conventional wipers, the collar provides an impervious fluid barrier. Thus, (even without the flexible membrane) hydraulic fluid must travel over the collar, making the hydraulic fluid migration path along the piston rod much more difficult (if not impossible) for fluid to traverse. Similarly, because the isolation regions atmospherically isolate the oily portion of the piston rod from the remainder of the piston rod, migration of hydraulic fluid and atomized or vaporized hydraulic fluid beyond the collar is prevented.

Contamination of the product gas by migrant hydraulic fluid is further prevented by maintaining the backside of the gas piston at a higher pressure than the pressure of the second isolation region adjacent thereto. In this manner hydraulic fluid that approaches the gas chamber bore is forced back toward the lower pressure second isolation region.

A number of additional features such as wiper regions and vents that further enhance product gas isolation are described in detail with reference to the figures contained herein. These and other objects, features and advantages of the present invention will become more fully apparent from the following detailed description of the preferred embodiments, the appended claims and the accompanying drawings.

DETAILED DESCRIPTION OF THE DRAWINGS

Figure 1:
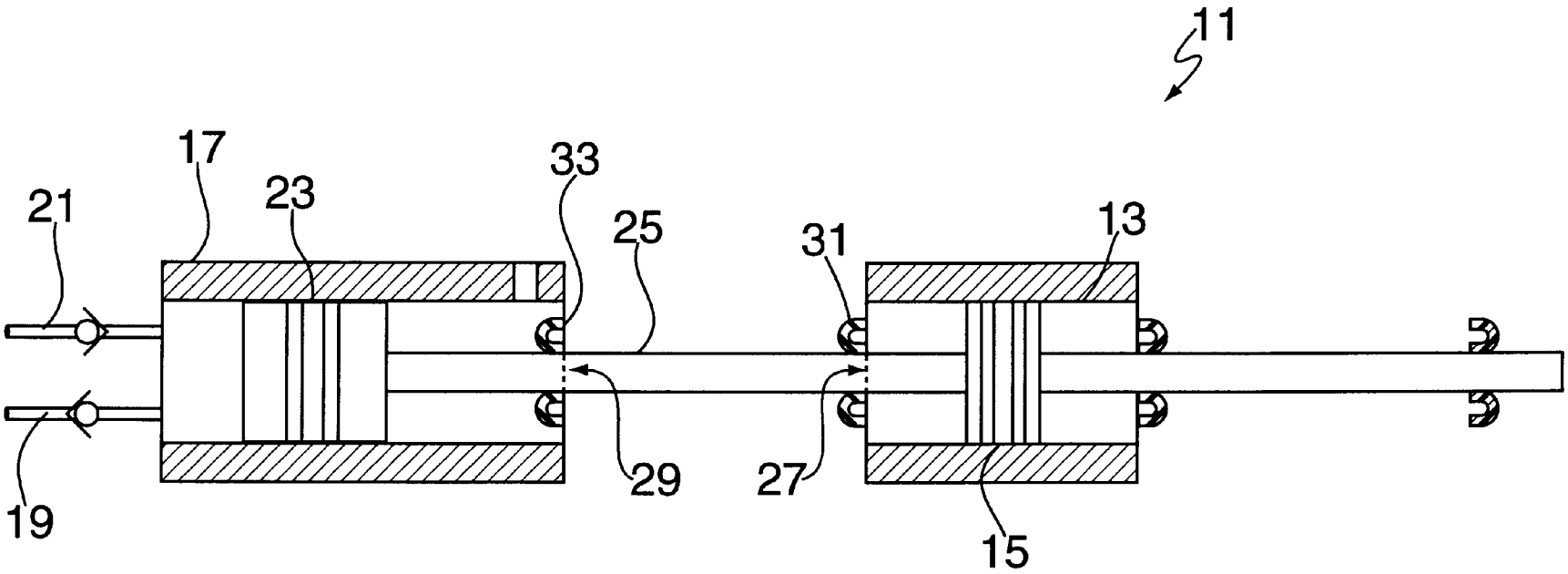
FIG. 1 (PRIOR ART)
FIG. 1 is a conventional high pressure gas compressor, as previously described.
Figure 2A:
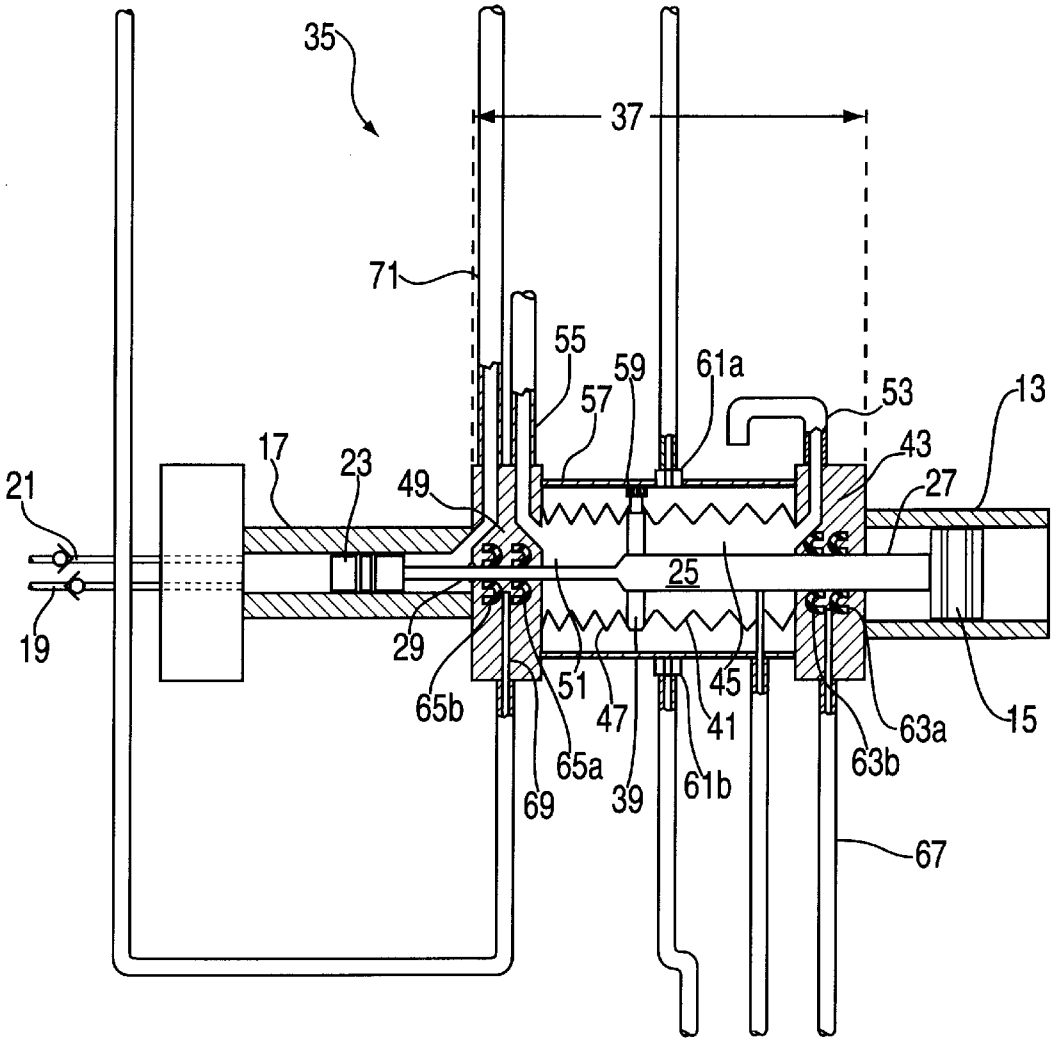
FIG. 2A is a side elevational cross section view of the compressor of the present invention.

FIG. 2A is a side elevational view, in section, of a compressor 35 made in accordance with the present invention. As compressor 35 includes some of the components contained in the conventional compressor 11 of FIG. 1, for convenience, the same reference numerals will be used herein for common components. The inventive compressor 35 comprises a hydraulic chamber 13 containing hydraulic fluid (e.g., oil) and a hydraulic piston 15, and comprises a gas chamber or piston chamber 17 that includes an inlet 19 for receiving the gas to be compressed (i.e., product gas) and an outlet 21 for supplying compressed product gas to a subsequent stage or to a standard processing chamber. The gas chamber 17 further includes a gas piston 23 operatively coupled to the hydraulic piston 15 by a piston rod 25 that extends through and is slidably mounted in a bore 27 (hereinafter "hydraulic bore 27") in the hydraulic chamber 13 and a bore 29 (hereinafter "gas bore 29") in the gas chamber 17.

The compressor 35 further comprises a region (isolation region 37) between the hydraulic chamber 13 and the gas chamber 17 configured to more effectively isolate the hydraulic fluid from the product gas. The isolation region 37 comprises a collar 39 preferably fixedly mounted to the piston rod 25 at a position such that neither the forward nor backward stroke of the piston rod 25 is inhibited, and such that the oily portion of the piston rod 25 is entirely on one side of the collar 39. A first flexible membrane 41 is sealed around the collar 39 and extends along the oily portion of the piston rod 25 to the hydraulic chamber 13, or preferably as shown in FIG. 2A, to a first wiper region 43 adjacent the hydraulic chamber 13. The first flexible membrane 41 is sealed to the first wiper region 43, and thus encloses the oily portion of the piston rod 25 within a first isolation region 45.

Similarly, a second flexible membrane 47 is sealed around the collar 39 and extends along the remaining portion of the piston rod 25 to the gas chamber 17, or preferably as shown in FIG. 2A, to a second wiper region 49 adjacent the gas chamber 17. The second flexible membrane 47 is sealed to the second wiper region 49, and thus encloses the remaining portion of the piston rod 25 within a second isolation region 51. The first isolation region 45 and the second isolation region 51 are provided with a first isolation region vent 53 and a second isolation region vent 55, respectively, so as to prevent deformation or rupture of the flexible membranes 41, 47 due to pressure variations as the volumes of the isolation regions 45, 51 change during operation of the inventive compressor 35. The isolation region vents 53, 55 are positioned so that the flexible membranes 41, 47 will not obstruct the isolation region vents 53, 55 when compressed.

To protect the flexible membranes 41, 47, the isolation regions 45, 51 are preferably encased in a protective canister 57 which may have one or more canister vents 61*a–b*. To prevent the collar 39 from rotating, and thereby twisting and potentially deforming or damaging the flexible membranes 41, 47, an anti-rotation bearing 59 couples the collar 39 to the canister 57 and prevents the collar 39 from rotating, which may in turn deform or damage the flexible membranes 41, 47.

The first wiper region 43 comprises a first pair of wipers 63*a*, 63*b*. Preferably, to prevent oil from accumulating in the first wiper region 43, a first hydraulic fluid drain vent 67 is positioned between the first pair of wipers 63*a*, 63*b* and along the bottom side of the piston rod 25. Additional hydraulic fluid drain vents 67 may be placed in the isolation region 45, close to the wipers 63*a*, 63*b*, to further prevent oil from accumulating in the isolation region 45. Similarly, the second wiper region 49 comprises a second pair of wipers 65*a*, 65*b*, and preferably at least one vapor vent 69. The vapor vent 69 further deters hydraulic fluid from reaching the gas chamber 17 and prevents gas applied to the backside of the gas piston 23 from flowing into the second isolation region 51 and deforming the flexible membrane 47.

To achieve further isolation between the hydraulic fluid and the product gas, the gas chamber 17 further comprises a backside gas supply 71. The backside gas supply 71 is positioned to be along the backside of the gas piston 23 regardless of whether the gas piston 23 is in the forward or backward stroke position.

In operation, a compressor motor (not shown) will cause the piston rod 25 to travel back and forth, sliding through the hydraulic bore 27 and the gas bore 29. During the backstroke the piston rod 25 and the hydraulic piston 15 travel further into the hydraulic chamber 13 causing the gas piston 23 to retract, and allowing product gas to flow into the gas chamber 17 via the inlet 19. The collar 39 moves toward the hydraulic chamber 13 and, accordingly, the first flexible membrane 41 and the first isolation region 45 compress, and the second flexible membrane 47 and the second isolation region 51 expand. As the first isolation region 45 compresses, air and any hydraulic fluid vapors entrained therein flow out of the first isolation region 45 via the first isolation region vent 53.

During the frontstroke, the piston rod 25 and the hydraulic piston 15 retract, traveling toward the gas chamber 17. The gas piston 23 travels further into the gas chamber 17, compressing the product gas, which then flows from the outlet 21. The collar 39 moves toward the gas chamber 17, and accordingly, the first flexible membrane 41 and the first isolation region 45 expand, and the second flexible membrane 47 and the second isolation region 51 compress. As the second isolation region 51 compresses, air and any hydraulic fluid vapors entrained therein flow from the second isolation region 51 via the second isolation region vent 55. During the frontstroke, the oily portion of the piston rod 25 travels out of the hydraulic chamber 13 via the hydraulic bore 27, and passes through the first wiper region 43. Hydraulic fluid is wiped from the piston rod 25 by the wiper 63*a* and drained from the first wiper region 43 via the first hydraulic fluid drain vent 67. Hydraulic fluid that passes the first hydraulic fluid drain vent 67 is further wiped from the piston rod 25 by the wiper 63*b*. Hydraulic fluid that nonetheless enters the first isolation region 45 is prevented from traveling into the second isolation region 51 by the collar 39 and by the first flexible membrane 41. Moreover, hydraulic fluid vapors are prevented from traveling into the second isolation region 51 by the first flexible membrane 41, and are exhausted from the first isolation region 45 (via the first isolation region vent 53) during the piston rod's 25 backstroke.

Any hydraulic fluid vapor that enters the second isolation region 51 despite the above mentioned isolation features, is vented therefrom via the second isolation region vent 55, and is prevented from entering the gas chamber 17 by the second pair of wipers 65*a*, 65*b*. The vapor vent 69 vents product gas (that leaks past the seals of the gas piston 23) or backside gas (gas on the backside of the gas piston 23—supplied via backside gas supply 71 as described below) which may blow by the second wiper 65*b*, thereby deterring the product gas or backside gas from entering the isolation region 51 and damaging the flexible membrane 47 due to overpressure.

The backside gas supply 71 may be a pressurized gas source or, preferably, part of a backside gas system (e.g., an accumulator assembly (described below)). Because the volume of the backside portion of the gas chamber 17 continuously increases and decreases as the gas piston 23 pumps back and forth, the pressure of the backside gas oscillates. To accommodate the pressure oscillations, the backside portion of the gas chamber 17 is normally vented to atmosphere. However, in order to conserve the backside gas (e.g., an inert, costly gas such as argon), and reduce cost associated with its loss, an accumulator assembly 72 (FIG. 2B) is preferably coupled to the backside of the gas chamber 17. In addition to conserving the backside gas, the accumulator assembly 72 isolates the backside gas from contaminants (e.g., particulates, condensed vapors, or gaseous contaminants) which otherwise might be drawn into the backside portion of the gas chamber 17 during compression of the high purity gas, if the backside portion of the gas chamber 17 was merely vented.

Figure 2B:
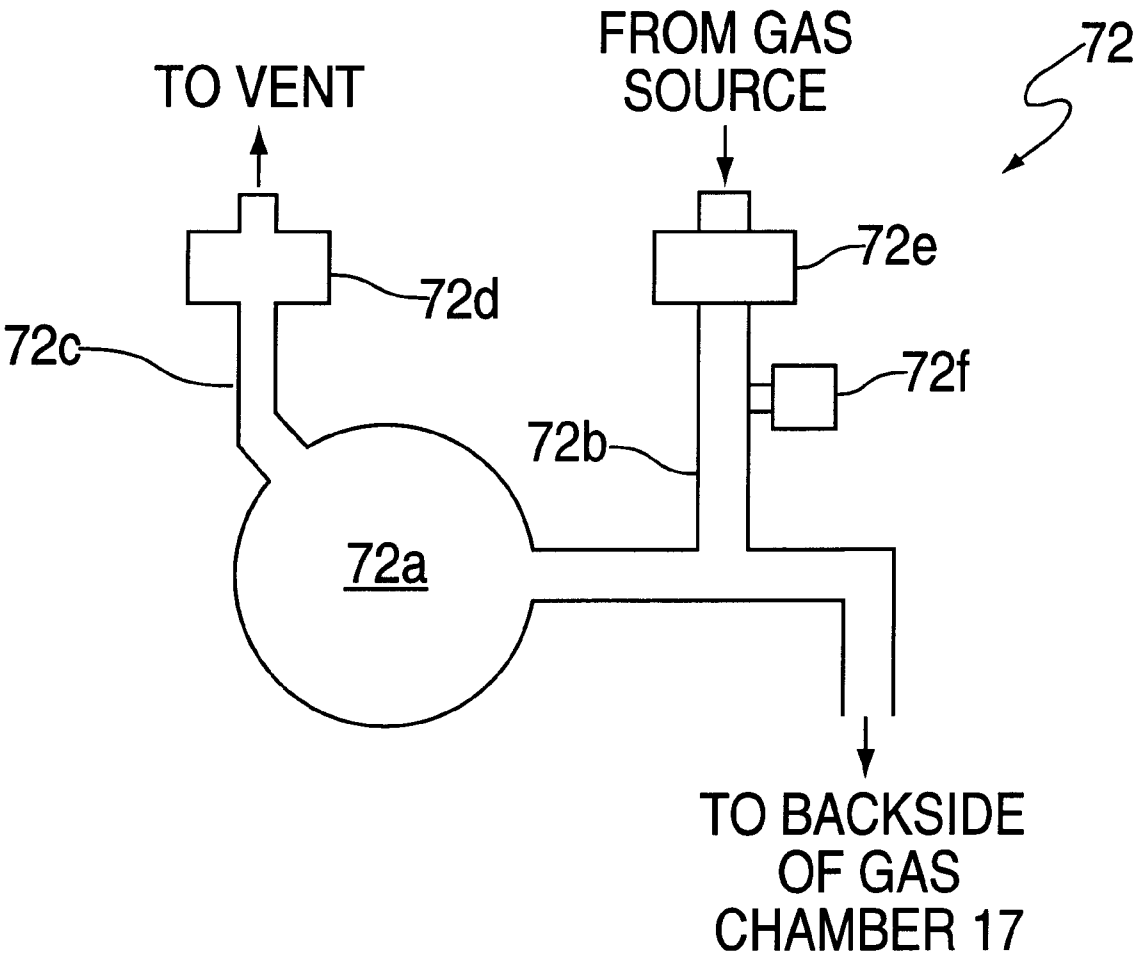
FIG. 2B is a diagrammatic side view of an accumulator system for the inventive compressor of FIG. 2A.

With reference to FIG. 2B, the accumulator assembly 72 comprises an accumulator chamber 72*a* having an input line 72*b* coupled to both a source of clean dry gas (not shown), and the backside of the gas chamber 17 of FIG. 2A; and an output line 72*c* coupled to a pressure relief device, preferably a check valve or relief valve 72*d* to protect the accumulator assembly 72 from blow-by from the frontside of the gas piston 23. A pressure regulator 72*e* is coupled to the input line 72*b* between the gas source and the backside of the gas chamber 17. A safety relief device 72*f* also may be coupled along the input line 72*b* between the pressure regulator 72*e* and the backside of the gas chamber 17 to provide additional blow-by protection should the relief valve 72*d* fail (e.g., remain in a closed position), or during extreme high pressure blow-by. The volume of the accumulator chamber 72*a* is preferably chosen such that the range of pressures experienced within the accumulator chamber 72*a* as the gas piston 23 pumps back and forth is within the pressure range between the set point of the pressure regulator 72*e* and the set point of the pressure relief valve 72*d*. In this manner, backside gas is conserved by the accumulator assembly 72 despite backside gas pressure/volume oscillations. Furthermore, the accumulator assembly 72 allows the backside gas pressure to be maintained within a pressure range low enough to allow the gas piston 23 to unimpededly retract, yet high enough to prevent contamination of the backside gas by "unclean" gas from the isolated region 51.

During both the frontstroke and backstroke of the piston rod 25, sufficient backside gas is supplied to the backside of the gas piston 23 to maintain a higher pressure in the backside portion of the gas chamber 17 than the pressure within the second isolation region 51. Thus, because any gas that leaks past the wipers 65*a*, 65*b* leaks from the cleaner backside of the gas piston 23 to the less clean isolation region 51 as described above, the isolation region 37 and the backside gas piston pressure differential of the inventive compressor 35 maintains product gas purity as the product gas is compressed.

Figure 3A:
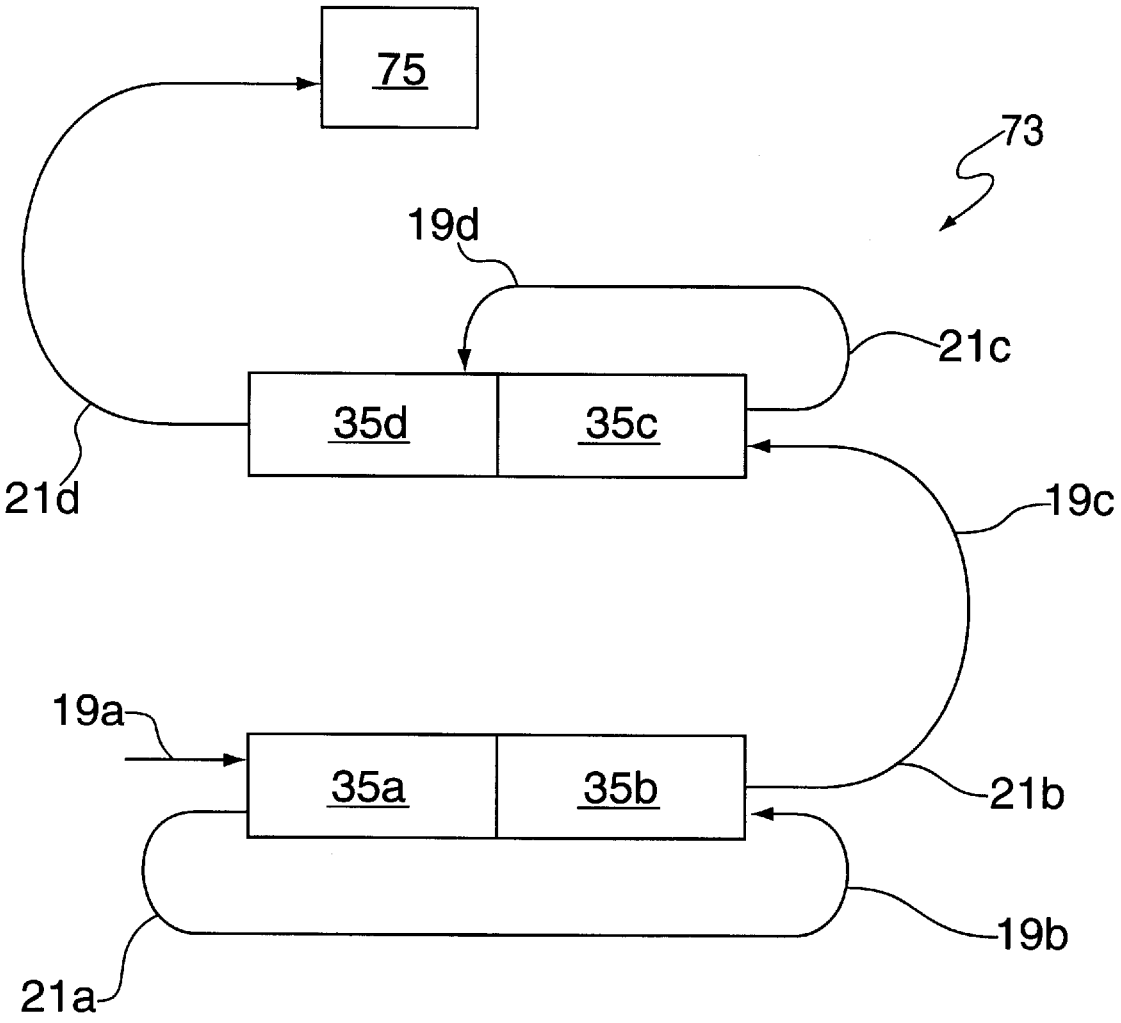
FIG. 3A is a schematic diagram of an exemplary pressure intensifier and semiconductor device processing chamber employing the inventive compressor of FIG. 2A.
Figure 3B:
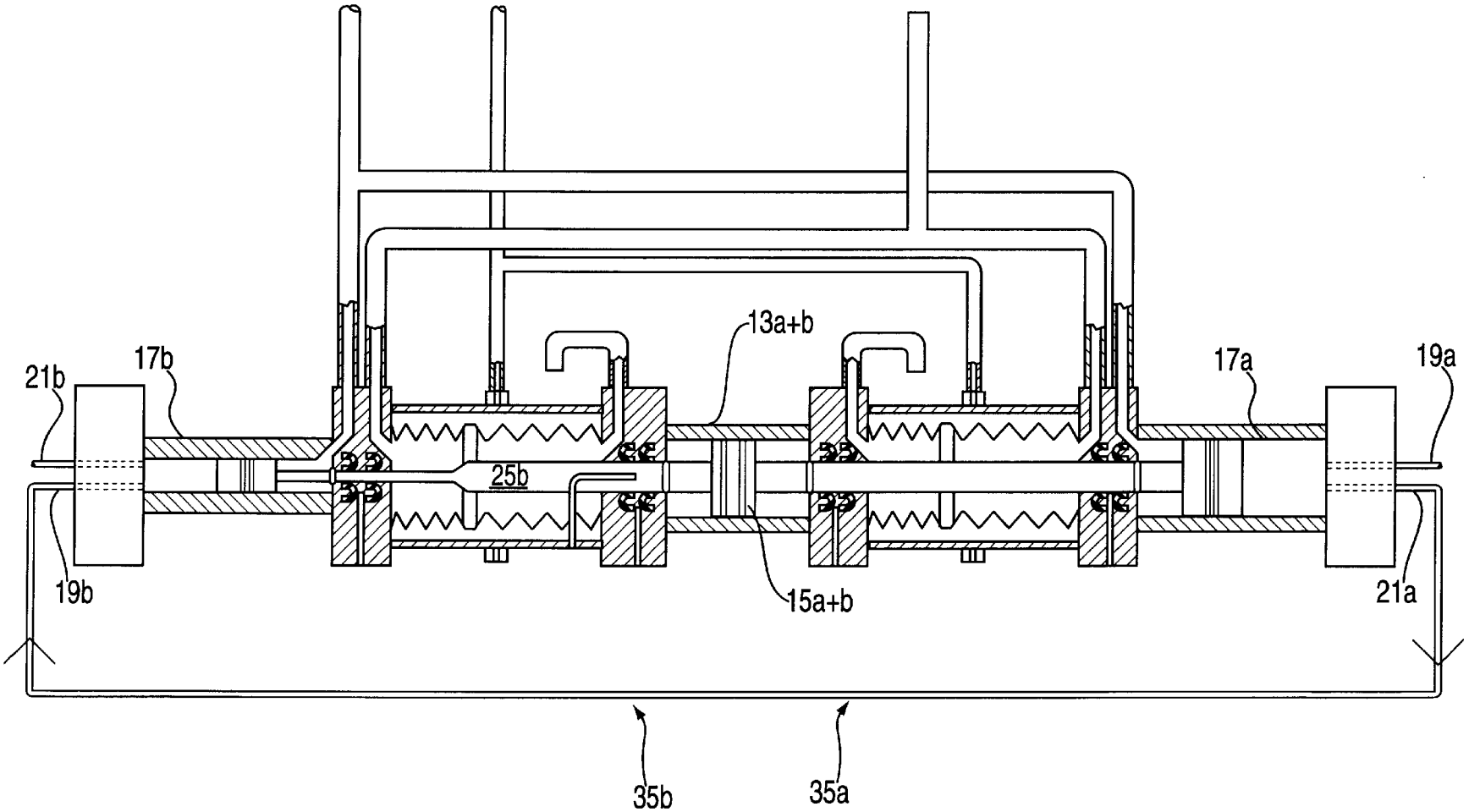
FIG. 3B is a side elevational view showing two stages of the pressure intensifier of FIG. 3A, having a double acting hydraulic chamber.

FIG. 3A is a schematic diagram of a four stage pressure intensifier 73 comprised of the inventive compressor 35 of FIG. 2A. The pressure intensifier 73 comprises four interconnected stages, with each of the four stages comprising the inventive compressor 35 of FIG. 2A. For convenience, features of the first, second, third and fourth stages are referenced with the postscripts "a," "b," "c" and "d", respectively. The inlet 19*a* of the first compressor 35*a* is coupled to a product gas source (not shown) and the outlet 21*a* of the first compressor 35*a* is coupled to the inlet 19*b* of the second compressor 35*b*. The outlet 21*b* of the second compressor 35*b* is coupled to the inlet 19*c* of the third compressor 35*c*, and the outlet 21*c* of the third compressor 35*c* is coupled to the inlet 19*d* of the fourth compressor 35*d*. The outlet 21*d* of the fourth compressor 35*d* is operatively coupled to a semiconductor device processing chamber 75. Further, as shown in FIG. 3A, the four stages are coupled in pairs of two, such that each pair of compressors shares a single hydraulic chamber 13 and a single hydraulic piston 15 (as shown in FIG. 3B). In this manner each hydraulic piston 15 and the piston rod 25 coupled thereto is double acting (i.e., while the first piston rod 25*a* is on the frontstroke in the first compressor 35*a*, the second piston rod 25*b* is on the backstroke in the second compressor 35*b*). Thus as the first piston rod 25*a* backstrokes the second piston rod 25*b* simultaneously frontstrokes (FIG. 3B).

As the first piston rod 25*a* backstrokes product gas is drawn into the first gas chamber 17*a* and simultaneously, the second piston rod 25*b* frontstrokes compressing product gas within the second gas chamber 17*b* and the compressed product gas passes from the second stage outlet 21*b* to the third stage inlet 19*c*. Thereafter the first piston rod 25*a* frontstrokes compressing product gas and, the second piston rod 25*b* backstrokes drawing product gas previously compressed within the first compressor 35*a* into the second gas chamber 17*b* via the second gas inlet 19*b*. The third and fourth compressors 35*c* and 35*d* operate in the same manner drawing compressed gas in from the previous stage and outputting compressed gas to the next stage and eventually to the semiconductor device processing chamber 75.

Within each compressor the isolation region 37 and the gas piston's 23 backside pressure repel hydraulic fluid from contaminating the compressed product gas. Accordingly the compressed product gas flowed into the semiconductor device processing chamber 75 is of a consistently high purity, and semiconductor device ruination due to contaminated product gas is greatly reduced.

Figure 4A:
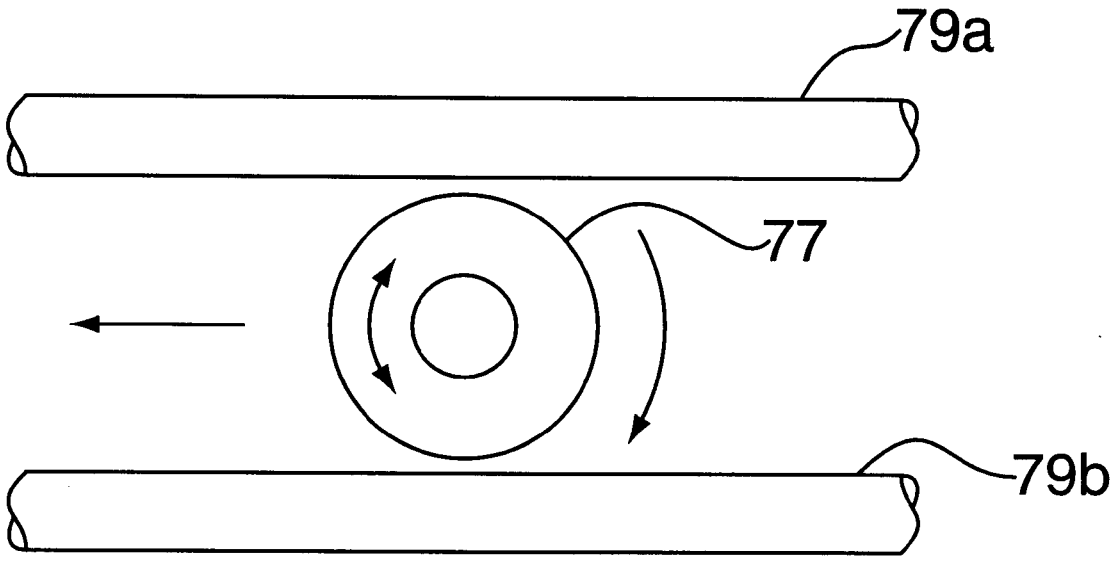
FIG. 4A is a partial top plan view of the anti-rotation bearing and guide rails for the inventive compressor of FIG. 2A.
Figure 4B:
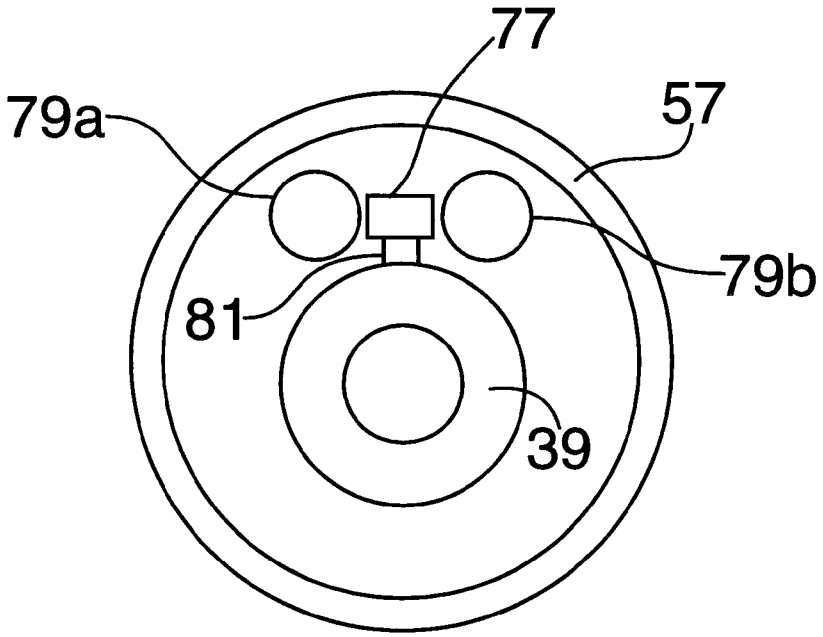
FIG. 4B is a front elevational view of the anti-rotation bearing of FIG. 4A.

FIG. 4A is a top plan view, of an anti-rotation bearing 77 and guide rails 79*a*, 79*b* for use with the collar 39, and FIG. 4B is a front elevational view of the anti-rotation bearing 77 and the guide rails 79*a*, 79*b* of FIG. 4A shown within the canister 57. The guide rails 79*a*, 79*b* preferably extend the length of the canister 57 (i.e., extend between the first wiper region 43 and the second wiper region 49) and may be coupled to the interior surface of the canister 57 at any position (top, bottom, side, etc.). The anti-rotation bearing 77 (preferably a ball bearing) is positioned between the guide rails 79*a*, 79*b*. The anti-rotation bearing 77 may be sized so as to maintain continuous contact with both guide rails 79*a*, 79*b* or, to reduce wear, may be sized such that at any given time a space exists between the anti-rotation bearing 77 and one or both guide rails 79*a*, 79*b*. A coupler 81 is preferably fixedly mounted on the collar 39 and extends therefrom a distance sufficient to position the anti-rotation bearing 77, which is coupled to the coupler 81, between the guide rails 79*a*, 79*b*.

In operation, the anti-rotation bearing 77 and guide rails 79*a*, 79*b* allow the collar 39 to freely move linearly between the first wiper region 43 and the second wiper region 49. If a space exists between the anti-rotation bearing 77 and the guide rails 79*a*, 79*b* the anti-rotation bearing 77 and the collar 39 coupled thereto may rotate slightly radially from a position wherein the anti-rotation bearing 77 contacts the guide rail 79*a* to a position wherein the anti-rotation bearing 77 contacts the guide rail 79*b*. Alternatively, if the anti-rotation bearing 77 is sized so as to maintain constant contact with both the guide rails 79*a*, 79*b*, the anti-rotation bearing 77 and the collar 39 coupled thereto are prevented from any radial rotation. Accordingly, depending on the size of the anti-rotation bearing 77 and the spacing between the guide rails 79*a*, 79*b*, the rotation of the collar 39 can be controlled. By controlling and limiting the rotation of the collar 39, the flexible membranes 41, 47 coupled thereto are protected from twisting which may interfere with the operation of the compressor 35 and/or may cause the flexible membranes 41, 47 to tear.

The foregoing description discloses only the preferred embodiments of the invention, modifications of the above disclosed apparatus and method which fall within the scope of the invention will be readily apparent to those of ordinary skill in the art. For instance, the first and second flexible membranes may be part of a single flexible membrane. The flexible membranes preferably will be configured as a bellows so as to fold in accordion type pleats when compressed. The collar may be slidably mounted (i.e., mounted so that the piston rod and/or the collar may move in relation to one another) on the piston rod and may comprise wipers coupled thereto so as to prevent hydraulic fluid migration along the piston rod. Further, the length of the isolation region is preferably equal to or greater than the length of the piston stroke. The various drains and vents within the inventive compressor preferably are vented to a position outside a chamber that encloses the compressor so that any collected hydraulic fluid may be viewed through a sight glass. Finally, the components of the inventive compressor preferably are cleaned prior to assembly to further reduce product gas contamination.

Accordingly, while the present invention has been disclosed in connection with the preferred embodiments thereof, it should be understood that other embodiments may fall within the spirit and scope of the invention, as defined by the following claims.

The invention claimed is:

1. An isolation stage coupled between a first fluid region and a second fluid region, said isolation stage having a piston rod operatively coupling the first fluid region and the second fluid region, said isolation stage comprising:

a collar mounted on said piston rod;

a first membrane sealingly coupled between said collar and said first fluid region for creating a first isolation region; and a second membrane sealingly coupled between said collar and said second fluid region for creating a second isolation region.

2. The isolation stage of claim 1 wherein said collar is fixedly mounted to said piston rod, and said first and second membranes are flexible so as to remain sealingly coupled to said collar as said piston rod travels back and forth.

3. The isolation stage of claim 2 wherein at least one of said first isolation region and said second isolation region has an isolation region vent for allowing gas to escape said at least one isolation region.

4. The isolation stage of claim 3 wherein the isolation region vent is positioned so that it is not obstructed by the flexible membrane as the volume of said at least one isolation region varies.

5. The isolation stage of claim 4 wherein said first isolation region and said second isolation region are surrounded by a protective canister.

6. The isolation stage of claim 5 wherein the protective canister has a canister vent for allowing gas to escape a region located between the flexible membranes and the canister.

7. The isolation stage of claim 2 further comprising:

a first wiper region coupled between the first fluid region and the first isolation region comprising:

a first wiper coupled to said piston rod so as to wipe at least a first portion of a first fluid from said piston rod as said piston rod travels past said first wiper;

a second wiper coupled to said piston rod so as to wipe a second portion of the first fluid from said piston rod as said piston rod travels past said second wiper; and at least a first wiper region vent positioned between said first and second wiper.

8. The isolation stage of claim 7 wherein a second wiper region is coupled between the second fluid region and the second isolation region and comprises a third wiper coupled to said piston rod so as to wipe a third portion of the first fluid from said piston rod as said piston rod travels past said third wiper, a fourth wiper coupled to said piston rod between the second fluid region and the third wiper, and at least a second wiper region vent positioned between said third wiper and said fourth wiper.

9. The isolation stage of claim 1 wherein the second isolation region is coupled adjacent said second fluid region, the second fluid region comprising:

a gas chamber having a piston head that divides the gas chamber into a frontside piston region and a backside piston region; and an inlet coupled to said backside piston region for flowing gas to the backside piston region so as to create a higher pressure with in the backside piston region than a pressure within said second isolation region.

10. The isolation stage of claim 9 wherein the pressure within the backside piston region is less than a pressure within the frontside piston region.

11. The isolation stage of claim 10 wherein the gas flowed to the backside piston region is a dry high purity gas.

12. The isolation stage of claim 2 further comprising an anti-rotation mechanism operatively coupled to at least one of the collar, the first membrane and the second membrane so as to deter at least one of the first or second membranes from deforming.

13. The isolation stage of claim 2 further comprising a canister surrounding the isolation stage; at least one guide rail within the canister extending in the direction between the first and second fluid regions; and an anti-rotation mechanism operatively coupled to at least one guide rail and to the collar so as to prevent the collar from rotating and causing a deformation of the first or second membrane.

14. The isolation stage of claim 13 wherein the anti-rotation mechanism comprises at least one rotating contact member.

15. The isolation stage of claim 14 comprising two guide rails.

16. The isolation stage of claim 15 wherein the anti-rotation mechanism is fixedly coupled to the collar.

17. A method of isolating a product fluid from an operating fluid comprising:

providing an isolation stage between a first fluid region and a second fluid region, said isolation stage having a piston rod operatively coupling the first fluid region and the second fluid region;

fixedly mounting a collar to said piston rod;

sealingly attaching a first membrane between said collar and said first fluid region to create a first isolation region; and sealingly attaching a second membrane between said collar and said second fluid region to create a second isolation region.

18. The method of claim 17 further comprising:

cleaning the isolation stage, the piston rod, the collar, the first membrane and the second membrane prior to said providing an isolation stage.

19. The method of claim 17 further comprising:

preventing the first and second membranes from rotating.

20. A pressure intensifier comprising:

a plurality of compressors, a first of the compressors inputting a product gas, compressing the product gas, and exhausting the compressed product gas; and a second of said plurality of compressors further compressing the compressed product gas and exhausting the further compressed product gas, each compressor of said plurality of compressors comprising:

an isolation stage coupled between a first fluid region and a second fluid region, said isolation stage comprising a piston rod operatively coupling the first fluid region and the second fluid region;

a collar mounted on said piston rod;

a first membrane sealingly coupled between said collar and the first fluid region for creating a first isolation region; and a second membrane sealingly coupled between said collar and the second fluid region for creating a second isolation region.

21. A semiconductor device fabrication system employing the pressure intensifier of claim 20.

* * * * *